United States Patent [19]

Wolfe et al.

[11] Patent Number: 4,870,835

[45] Date of Patent: Oct. 3, 1989

[54] REFRIGERATED CONTAINER

[76] Inventors: George R. Wolfe; John J. Wolfe, both of P.O. Box 520, Savannah, Tenn. 38372

[21] Appl. No.: 190,124

[22] Filed: May 4, 1988

[51] Int. Cl.[4] ..... A47F 3/04

[52] U.S. Cl. ..... 62/246; 62/430; 62/440; 62/439

[58] Field of Search ..... 62/246, 305, 430, 440; 312/236, 237

[56] References Cited

U.S. PATENT DOCUMENTS

| | | | |
|---|---|---|---|
| 1,691,706 | 11/1928 | Daemicke . | |
| 2,014,837 | 9/1935 | Daemicke | 62/95 |
| 2,124,110 | 7/1938 | Hall | 62/126 |
| 2,523,807 | 9/1950 | Borghesan | 257/124 |
| 2,599,198 | 7/1951 | Ogden | 257/124 |
| 2,637,530 | 5/1953 | Janos | 257/17 |
| 2,856,163 | 10/1958 | Bidak et al. | 257/256 |
| 2,959,941 | 11/1960 | McDonald | 62/458 |
| 3,308,633 | 3/1967 | Kritzer | 62/246 X |
| 3,308,635 | 3/1967 | Tenniswood et al. | 62/277 |
| 3,335,757 | 8/1967 | Lynch | 138/111 |
| 3,491,548 | 1/1970 | Christiansen | 62/246 X |
| 3,498,371 | 3/1970 | Zygiel | 165/164 |
| 3,557,868 | 1/1971 | Burkell | 165/71 |
| 3,747,364 | 7/1973 | Laing | 62/439 X |
| 3,832,862 | 9/1974 | Ingels | 62/227 |
| 3,912,005 | 10/1975 | Griffiths | 165/169 |
| 4,055,162 | 10/1977 | Gonzalez | 126/271 |
| 4,182,405 | 1/1980 | Hysen et al. | 62/246 X |
| 4,306,616 | 12/1981 | Woods, Jr. et al. | 165/136 |
| 4,393,659 | 7/1983 | Keyes et al. | 62/66 |
| 4,407,143 | 10/1983 | Wolfe | 62/303 |
| 4,615,183 | 10/1986 | Juncos et al. | 62/306 |

OTHER PUBLICATIONS

Frigibar Industries, Inc., "37 Ways to Keep Your Cool Afloat", 2 pp. sales brochure.

Gildden, "Select Colors in GEL-KOTE Finishes," 4 pp. sales brochure.

Reichold Chemicals, Inc., "Selection Guide for Reichhold Polylite Polyester Resins," pp. 3-23.

Advanced Plastics, Inc., "Reinforced Plastic Materials," sales literature.

CertainTeed FiberGlass, Data Sheets M123B1, 318 322 324 319 325, product descriptions and price lists.

Eman, "Mold Making With Stypol Polyesters," 4 pp.

Rexco Chemical Company, "Product Bulletin: Partall Mold Release Agents," Film #10, Paste #2, 2 pp.

SSI, "The SSI Ultimate Refrigerated Cooler," 1 p., sales brochure.

*Primary Examiner*—Henry A. Bennet

*Attorney, Agent, or Firm*—Fleit, Jacobson, Cohn, Price, Holman & Stern

[57] ABSTRACT

A refrigerated container is provided made from fibrous mat reinforced thermosetting resin. In one embodiment, a condiment holder is provided with a top plate which includes a plurality of openings extending along the plate for supporting individual condiment containers within the holder, the plate having formed thereon a layer of frost thereby giving the appearance of the condiments resting in ice. The condiment holder comprises a conventional refrigeration unit which passes refrigerant through refrigerant lines encased in the top plate adjacent each and every one of the plate openings thereby producing the frost or ice layer along the top surface of the plate and providing a refrigerated storage area below the top plate within the condiment holder to maintain the individual condiments refrigerated. In another embodiment, a chill tank, freezer tank or the like for use in the boating industry is provided having refrigerant lines encased in the fibrous mat reinforced thermosetting resin.

23 Claims, 9 Drawing Sheets

REFRIGERATED CONTAINER

BACKGROUND OF THE INVENTION

This invention relates generally to a refrigerated container such as a condiment holder and, more particularly, to condiment holders which are commonly known as frost top units which give the appearance that the individual condiments are resting in ice.

Specifically, the present invention relates to improvements over prior art refrigerated containers such as frost top condiment holders used extensively for displaying condiments or other foods for self-service of such foods in many restaurants.

For the past few years, the addition of self-service salad bars in restaurants of all types has shown a tremendous increase. One of the attractive features of many salad bars is produced by what is commonly known as a frost top unit which frosts so as to give the appearance that the salad, as well as the additional condiments, vegetables, dressings and the like are resting in ice. An especially commercially successful example of a frost top unit is the frosted condiment holder disclosed in U.S. Pat. No. 4,407,143, issued Oct. 4, 1983, to John J. Wolfe, one of the present co-inventors. The frosted condiment holder of U.S. Pat. No. 4,407,143 overcomes disadvantages of prior frost top units by effectively holding the individual foods in one place, thereby preventing the individual food items from being moved around to a position other than one which allows convenient self-service or a visually pleasing display. Also, condiments which are contained in individual condiment containers placed in the frosted condiment holder of U.S. Pat. No. 4,407,143 are refrigerated throughout by the refrigerated storage area below the frosted top.

While the frosted condiment holder of U.S. Pat. No. 4,407,143 has been especially commercially successful, there is still a need in the art for a less expensive and more efficient frost top unit. Moreover, there is a need in other arts, such as the boating industry (e.g., chill tanks, freezer units), for a refrigerated container which is relatively inexpensive and efficient.

SUMMARY OF THE INVENTION

Briefly, the present invention is an improvement over prior art refrigerated containers such as frost top units used for displaying salads and associated condiments and the like. In accordance with one aspect of the present invention, a refrigerated condiment holder is provided, the condiment holder including a top plate which is covered with a layer of frost due to refrigerant conduits in the top plate, the top plate being provided with a plurality of container openings through which containers carrying foods may be placed. The condiment holder of the present invention includes a cooled storage area below the frosted-top plate which maintains the foods in a fresh condition.

The refrigerated condiment holder is made from a thermosetting resin, such as polyester resin, and a reinforcing mat of fibrous material, such as fiberglass. The refrigerant conduits are sandwiched between laminated layers of thermosetting resin/reinforcing mat in the top plate and are in heat exchange contact with the top surface of the top plate.

The refrigerated condiment holder is made by molding techniques. A male mold or plug is constructed of the part to be produced. A female mold is then produced using fibrous mat reinforced thermosetting resin.

The refrigerated condiment holder part is then made from the mold.

In accordance with another aspect of the present invention, a chill tank, freezer unit or other refrigerated container is provided for use in the boating industry. The refrigerated container is made using molding techniques and has embedded refrigerant conduits which will not be damaged by the fish or other material (e.g., bait) stored in the container.

A primary object of the present invention, therefore, is to provide an improved refrigerated container such as a frosted condiment holder which is less expensive to manufacture and more efficient than prior refrigerated containers.

In accordance with the foregoing object, another object of one aspect of the invention is to provide a refrigerated condiment holder made from fibrous mat reinforced thermosetting resin which includes a frosted top to provide the appearance of the condiments resting in ice and in which the top comprises a plurality of tray openings for the holding of individual food or condiment containers, the holder further including a refrigerated storage area positioned below the frosted top and which provides cooling of the bulk of the individual containers extending through the frosted top.

A further object of one aspect of the present invention is to provide a refrigerated condiment holder made from fibrous mat reinforced thermosetting resin provided with a decorative frost top unit which is capable of holding and maintaining in position a plurality of foods and condiments and maintaining the foods and condiments cool and fresh.

A still further object of another aspect of the present invention is to provide a refrigerated container such as a chill tank, freezer unit or other refrigerated container used in the boating industry which is made of fibrous mat reinforced thermosetting resin and which has refrigerant conduits embedded in the fibrous mat reinforced thermosetting resin.

These, together with other objects and advantages which will become subsequently apparent, reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
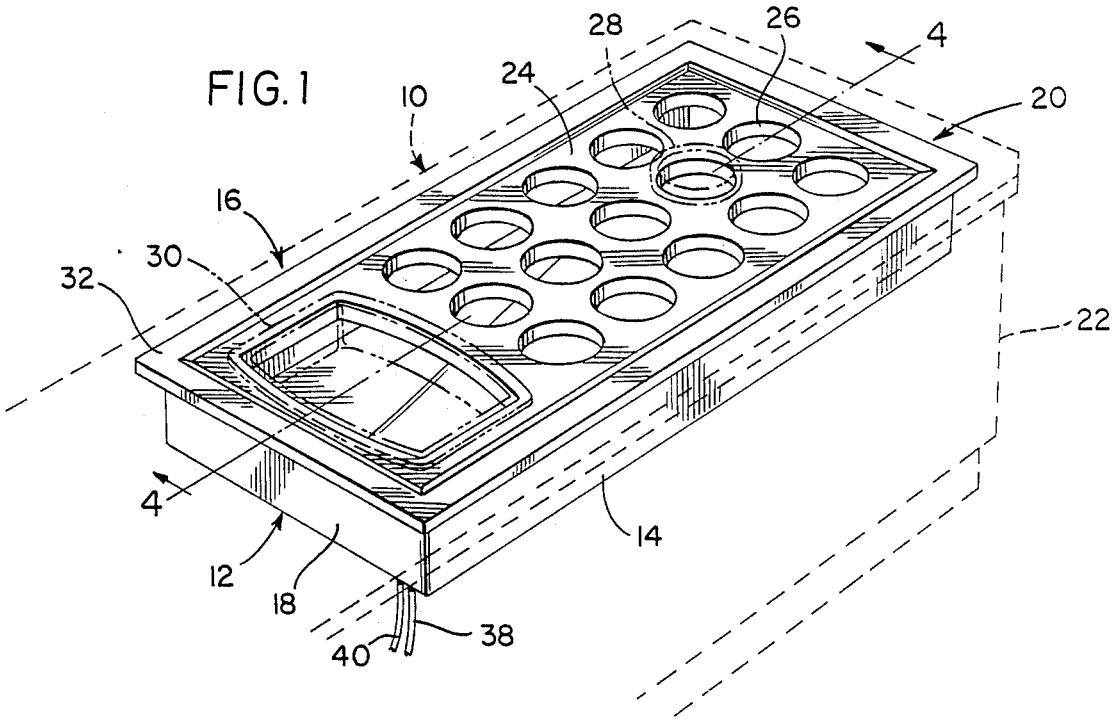
FIG. 1 is a perspective view illustrating a refrigerated condiment holder of the present invention.
Figure 2:
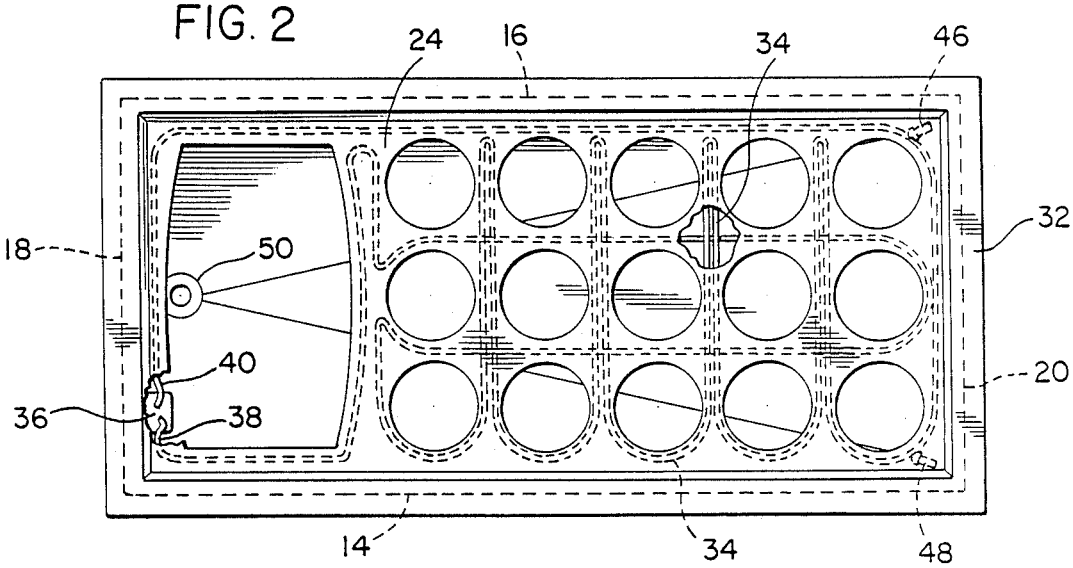
FIG. 2 is a top plan view of the frosted condiment holder partly broken away to illustrate the placement of the refrigerant conduits utilized to form the frosted top plate and to maintain the storage area therebelow refrigerated.
Figure 3:
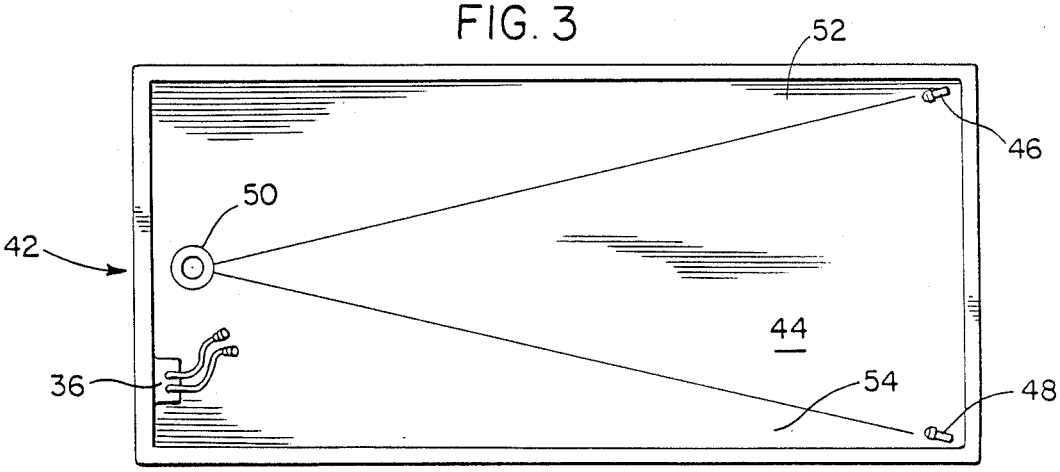
FIG. 3 is a top elevational view of the condiment holder of the present invention with the frosted top unit and associated refrigerant conduits removed and thus illustrates the self-draining fluid cleaning system.

Referring to FIGS. 1 through 3, the refrigerated condiment holder of the present invention generally indicated by reference numeral 10 comprises a generally rectangular-shaped base 12 formed by sidewalls 14 and 16 and end walls 18 and 20. Base 12, if desired, can be supported by a base cabinet 22. Base 12 may take many forms and shapes in order to accommodate the numerous variety of sites and situations in which condiment holder 10 may be utilized. Positioned over base 12 is frost top unit 24 which is a plate containing a plurality of container openings 26 which may be of varying size, although for the purposes of illustration only, all of openings 26 are shown of the same diameter, except the opening for receiving a salad bowl. Openings 26 support a plurality of condiment containers 28 and a salad bowl 30 which usually include an outer rim or lip which extends over the surface of frost top unit 24. Frost top unit 24 further includes an outer perimeter lip 32 which can be used to secure frost top unit 24 onto base 12.

Positioned in frost top unit 24 and embedded therein is refrigerant conduit 34, which can be seen in FIG. 2 as following a path which travels adjacent each of container openings 26 such that each opening 26 is virtually surrounded by refrigerant conduit 34. As can be seen, refrigerant conduit 34 travels between each row of openings 26, as well as between each column thereof and between the outermost openings 26 and the outer perimeter of frost top unit 24. Refrigerant conduit 34 also travels around salad bowl 30. In this manner, a layer of frost or ice forms on the top of frost top unit 24 and maintains the individual condiment containers 28 and salad bowl 30 and their contents refrigerated. Refrigerant conduit 34 is essentially the evaporator of a conventional refrigeration system which includes a refrigerant vapor compressor and compressed vapor refrigerant condenser (not shown). Refrigerant conduit 34 is linked to the conventional refrigeration system by means of holder 36, which holds conduit inlet 38 and refrigerant return 40, which returns the evaporated refrigerant that travelled the total path along frost top unit 24 by means of refrigerant conduit 34.

Positioned underneath and spaced from frost top unit 24 is water or cleaning fluid flush system 42, which comprises pan 44 shaped so as to direct all water or cleaning fluid dispensed from nozzles 46 and 48 to drain 50. Nozzles 46 and 48 direct water or chemical cleaning fluid onto the top surface of pan 44, thus cleaning or flushing any contaminants thereon into drain 50. As can be seen, nozzles 46 and 48 are spaced so as to disperse cleaning fluid substantially over the entire surface of pan 44. The self-draining feature of pan 44 is provided by the inwardly slanting sidewalls 52 and 54, which direct the fluid onto downwardly slanted surface 53 which provides for movement of the cleaning fluid by gravity into drain 50.

Figure 4:
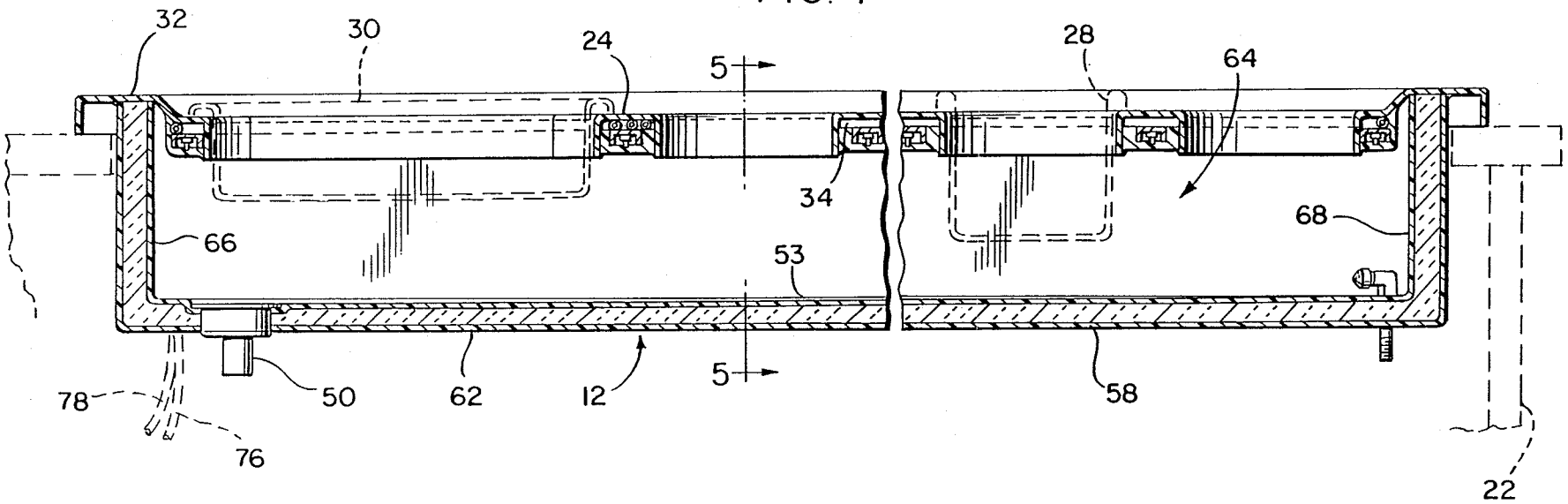
FIG. 4 is a longitudinal sectional view of the frosted condiment holder taken generally along the line 4—4 of FIG. 1.
Figure 5:
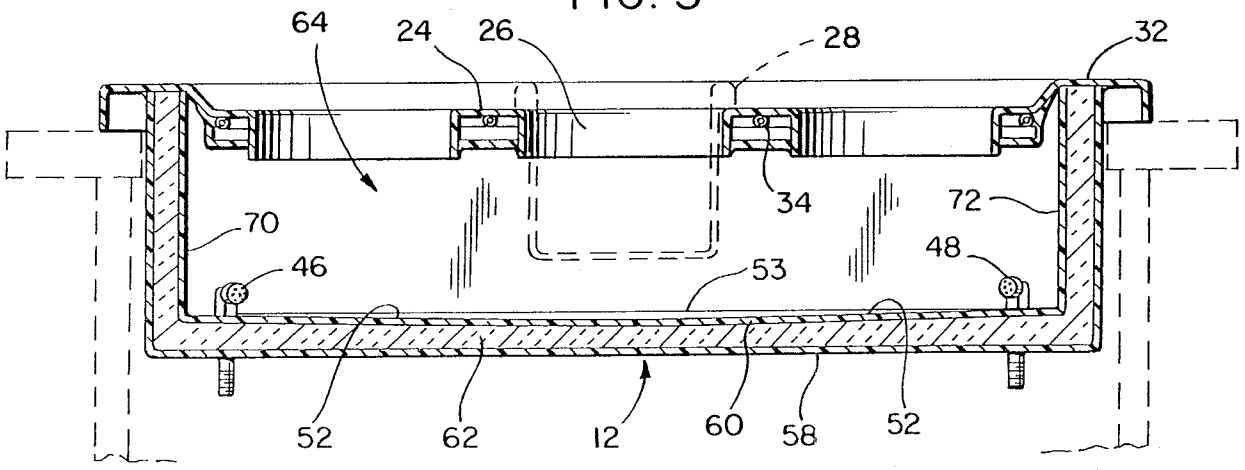
FIG. 5 is a transverse sectional view of the frosted condiment holder taken generally along the line 5—5 of FIG. 4.

A detailed arrangement of the components which form condiment holder 10 can be seen in FIGS. 4 and 5. As can be seen, base 12 further includes a bottom wall 58 and top wall 60. Placed adjacent each end and sidewall of base 12 is a layer of thermal insulation 62 which maintains what can be characterized as storage area 64 cold so as to provide refrigeration of the contents placed in containers 28 and 30, the major portion of which extends into storage area 64. Storage area 64 is formed by the space existing between frost top unit 24 and pan 44 and is further bounded by end walls 66 and 68 and sidewalls 70 and 72 of water flush system 42.

Refrigerant conduit 34 is embedded in frost top unit 24. Refrigerant conduit 34 is positioned to pass the refrigerant along each side of container openings 26, as illustrated in FIGS. 2 and 4. Refrigerant conduit 34 receives the expanding refrigerant via connector 76 connecting a conventional expansion valve (not shown) to holder 36, while conduit 78 returns evaporated and warmed refrigerant from holder 36 to the compressor unit (not shown).

The spray nozzles 46 and 48 can be supplied from a supply conduit (not shown) which is linked to a source of water or cleaning fluid (not shown). A common T-connector can be used to supply both spray nozzles 46 and 48 from the supply conduit. Likewise, a separate supply conduit may be utilized to supply each of the respective spray nozzles. The downward slanting floor of center section 53 of pan 44 allows all wash water or fluid to enter drain 50, which is fastened to a drain pipe (not shown) for removal of spent fluid from condiment holder 10.

In operation, a conventional refrigeration system supplies refrigerant to refrigerant conduit 34, which is placed in heat conducting contact with the top of frost top unit 24 so as to form a layer of frost or ice thereon due to condensation from the atmosphere. Refrigerant is passed throughout the total area of frost top unit 24 so as to cool the tops of each of containers 28 and 30 placed in openings 26. Further, storage area 64 being insulated from the atmosphere by means of insulation layer 62 is also cooled by means of the expanding refrigerant through refrigerant conduit 34 and thus refrigerates the contents contained within containers 28 and 30. By forming storage area 64 within condiment holder 10, relatively larger containers 28 and 30 can be utilized and thus hold a relatively larger quantity of salad dressings and other condiments and the like and yet remain refrigerated and thus fresh. Further, the tops of containers 28 and 30 remain substantially flush with frost top unit 24, enhancing the appearance of the food display by giving the appearance of containers resting in ice due to the formation of the frost layer on the surface of frost top unit 24. Once refrigerant has passed throughout the full circuit laid down by refrigerant conduit 34, warmed refrigerant is returned to the refrigeration unit via conduit 78. Periodic cleaning of condiment holder 10 is accomplished by simply opening nozzles 46 and 48 which dispense the stream of cleaning fluid along the sides and bottom surface of pan 44, thus removing any contaminants which may have adhered thereto. The cleaning fluid and contaminants are removed by gravity flow through drain 50. In this manner, condiment holder 10 does not have to be disassembled for each cleaning.

The refrigerated, condiment holder 10 is made by molding techniques. A male mold or plug is constructed of the part to be produced. A female mold is then produced using fibrous mat reinforced thermosetting resin. The refrigerated condiment holder part is then made from the mold.

The term "mat" is intended to include a cloth of fibrous material. The fibrous material is preferably fiberglass; however, other fibrous material, such as polyester, can be used. A variety of weights of fibrous mat may be used, but a 1½ oz./sq. ft. mat is typical for a refrigerated condiment holder application. The thermosetting resin is preferably a polyester resin, especially a polyester resin which is curable at ambient temperatures. Another example of a suitable thermosetting resin is an epoxy resin. In some applications, it is desirable to incorporate a heat conductive filler, such as particles of aluminum, in the resin and/o mat.

The fibrous mat reinforced thermosetting resin may be applied by hand lay-up or spray-up techniques, but hand lay-up is presently preferred. The hand lay-up and spray-up techniques for applying a fibrous mat reinforced thermosetting resin are well-known in the art. About three to four layers of fibrous mat reinforced thermosetting resin are typically used in forming the refrigerated condiment holder part and mold, respectively. The final thickness of the fibrous mat reinforced thermosetting resin is typically about 3/16" to ½".

Figure 6:
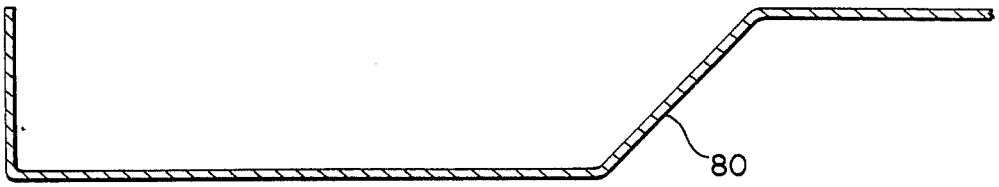
FIG. 6 is a fragmentary cross-sectional view of an edge portion of a plug for making a frost top unit of a refrigerated condiment holder.

Referring to FIG. 6, a male mold or plug 80 of the frost top unit is formed. The plug 80 may be formed from stainless steel, as illustrated in FIG. 6, or from some other suitable material for a plug. Since frost top units 24 of the type disclosed in U.S. Pat. No. 4,407,143 are commercially made of stainless steel, the commercial stainless steel frost top unit can be used as the plug 80.

Figure 7:
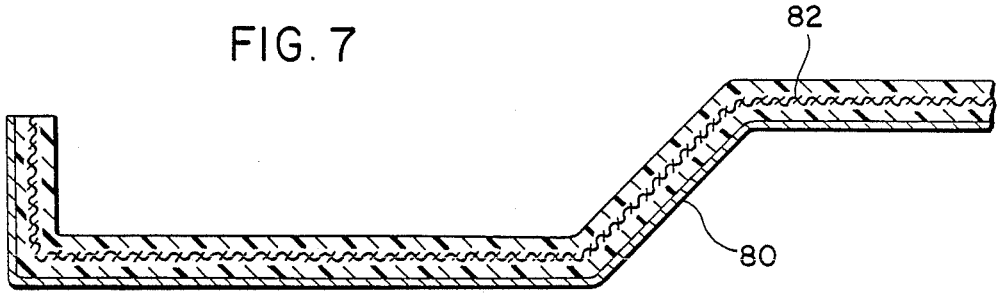
FIGS. 7 to 9 are fragmentary cross-sectional views of an edge portion of a mold for making a frost top unit of a refrigerated condiment holder showing successive steps of making the mold.
Figure 8:
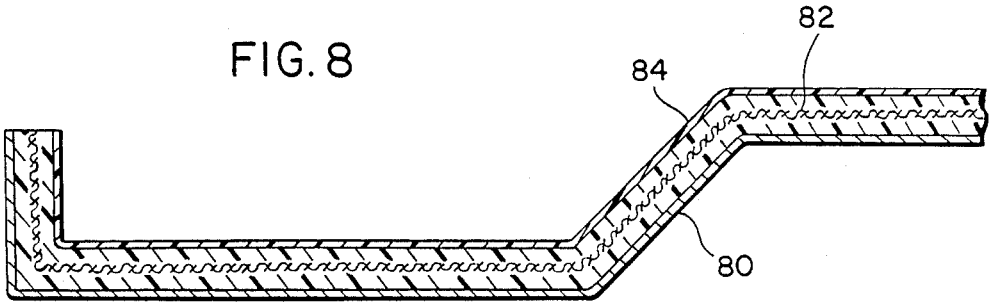
Figure 9:
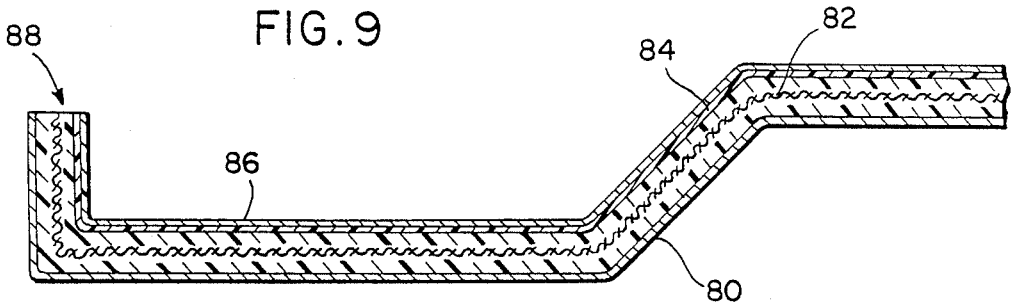

The first step in forming a mold is to apply a layer of fibrous mat reinforced thermosetting resin 82 to the plug 80, as illustrated in FIG. 7. A protective color layer 84, such as a layer of paint, which is commonly referred to as "gel-coat", is then applied to the fibrous mat reinforced thermosetting resin, as illustrated in FIG. 8. Finally, a release layer 86, such as a layer of wax, is applied over the protective color layer 84. The release layer 86 may be applied prior to removal of the mold 88 from the plug 80, as illustrated in FIG. 9, or after the mold 88 is separated from the plug 80. The release layer will be periodically renewed as parts are manufactured from the mold.

Figure 10:
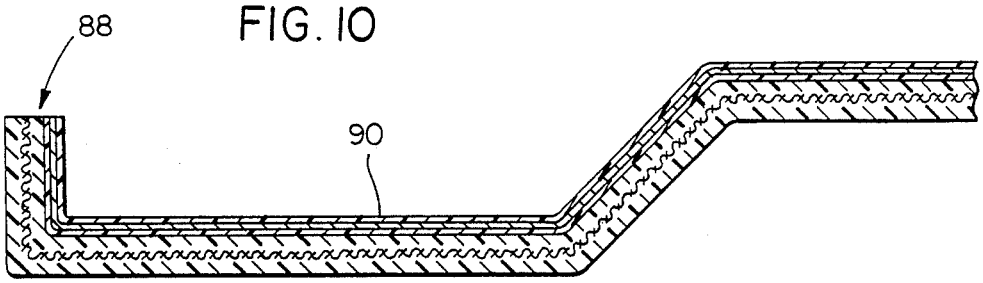
FIGS. 10 to 17 are fragmentary cross-sectional views of an edge portion of a frost top unit of a refrigerated condiment holder showing successive steps of making the frost top unit in a mold.

FIG. 10 illustrates the first step in manufacturing a frost top unit from a mold 88 which, as illustrated in FIG. 10, is separated from the plug 80. This first step comprises applying a protective color layer 90, such as a layer of paint, to the mold 88. As will be appreciated, this protective color layer 90 will become the exterior surface coating of the frost top unit and will frost and give the appearance of ice during the use of the refrigerated condiment holder.

Figure 11:
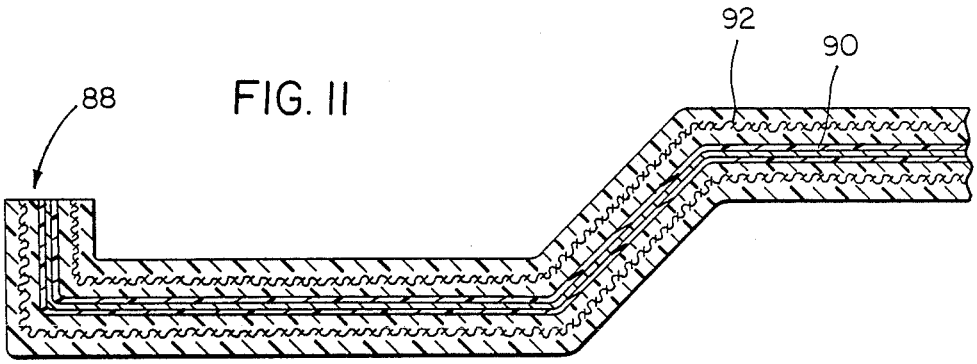
Figure 12:
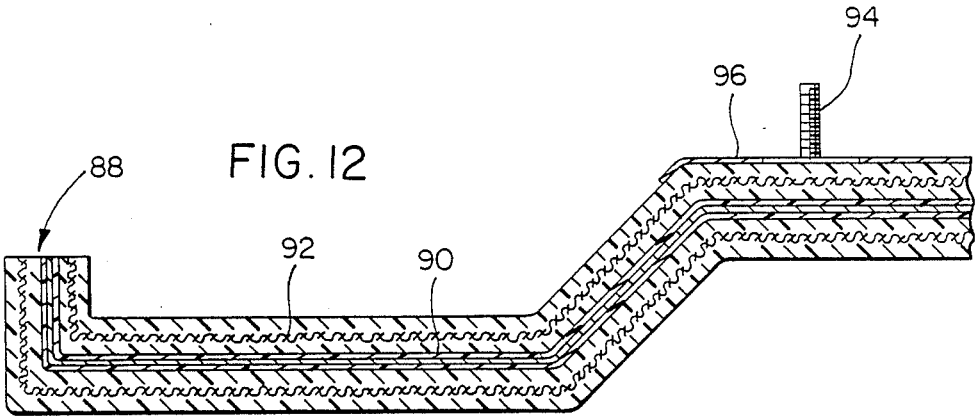

As illustrated in FIG. 11, a fibrous mat reinforced thermosetting resin layer 92 is applied over the protective color layer 90. A stud 94 is attached to the fibrous mat reinforced thermosetting resin layer 92, and a sheet of heat conducting material 96, such as a sheet of lead, is applied over the fibrous mat reinforced thermosetting resin layer 92, as illustrated in FIG. 12.

Figure 13:
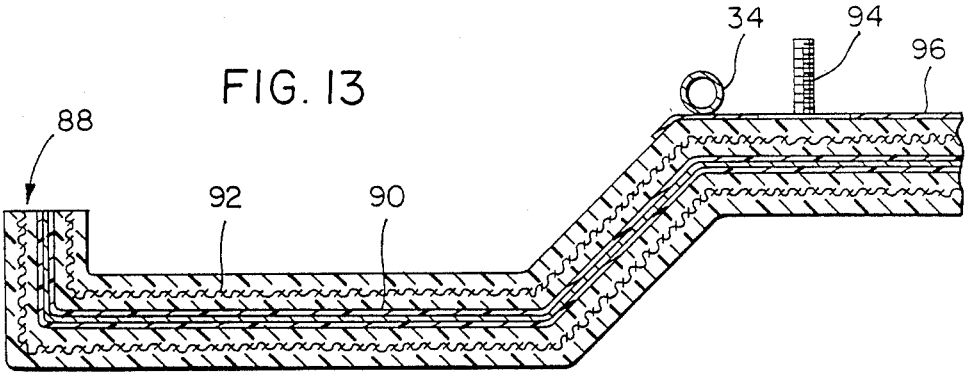
Figure 14:
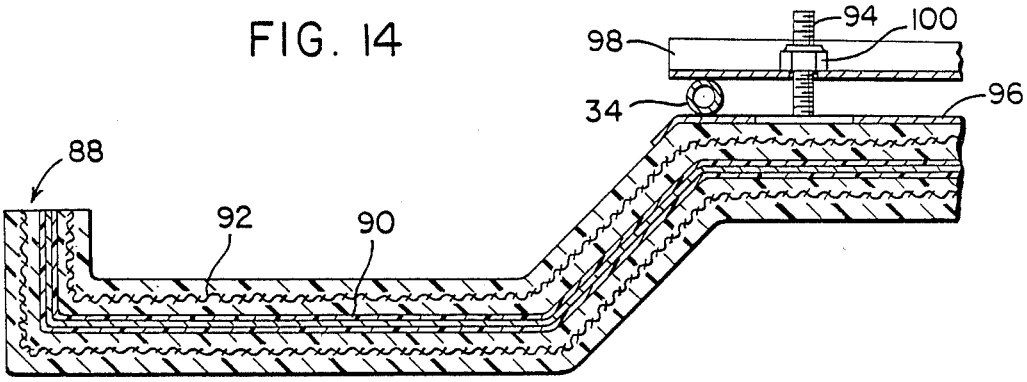

The next step in the manufacturing method comprises applying refrigerant conduit 34 (e.g., copper tubing) at spaced locations over the sheet of heat conducting material 96, as illustrated in FIG. 13. FIG. 14 illustrates one means which may be used to maintain the refrigerant conduit 34 in good heat conducting contact with the sheet of heat conducting material 96. As illustrated in FIG. 14, a crossbar 98 (e.g., a, metal U-shaped member in axial cross-section) is placed over the refrigerant conduit 34 to hold the refrigerant conduit 34 against the sheet of heat conducting material 96 by means of nut 100 threaded onto the stud 94.

Figure 15:
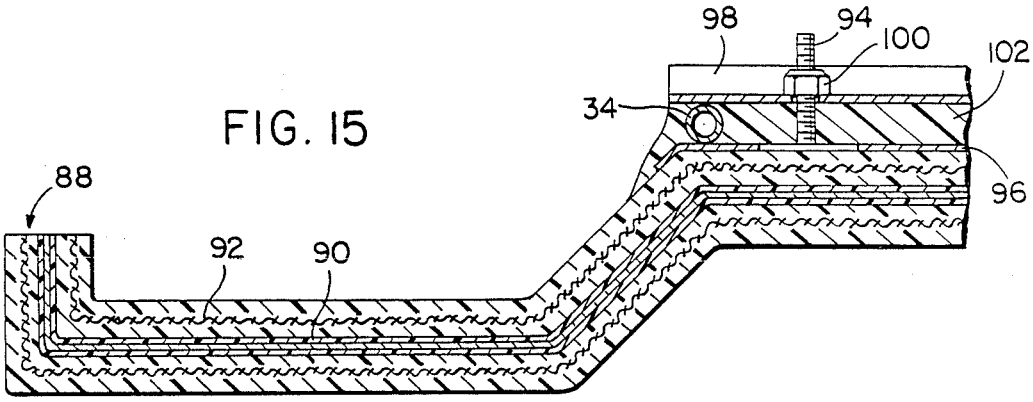

Referring to FIG. 15, a good heat conducting material 102, such as thermal mastic, is applied around and adjacent to the refrigerant conduit 34. The thermal mastic 102 may be applied before or after the crossbar 98 is installed, as illustrated in FIG. 14.

Figure 16:
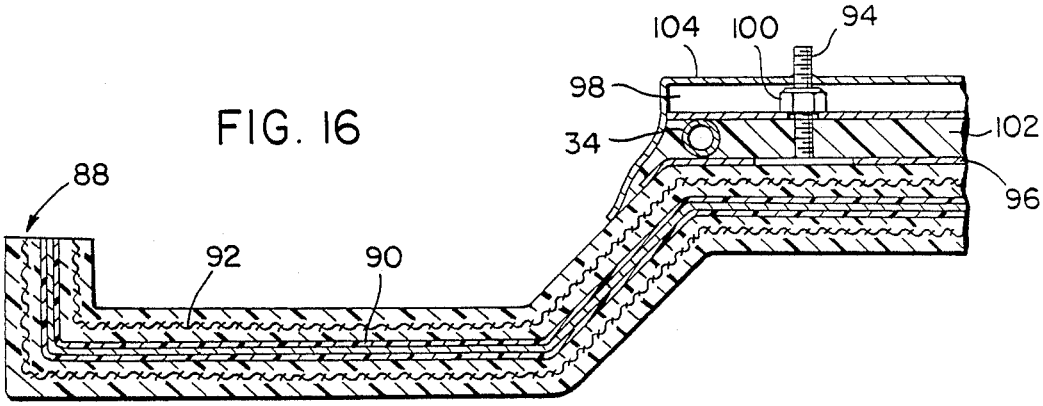
Figure 17:
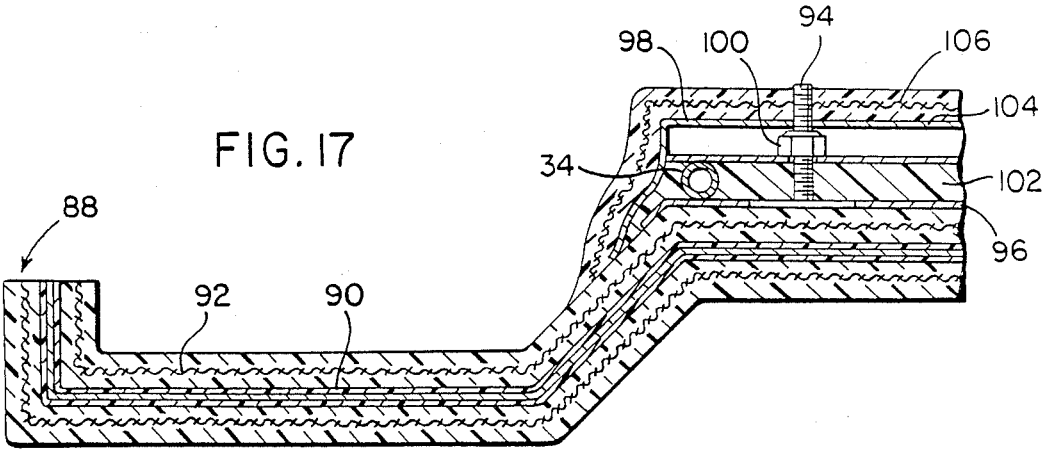

The next step in the manufacturing method is the application of a vapor barrier 104, such as aluminum foil typically 0.010 to 0.012 inch thick, adjacent the layer of thermal mastic 102, as shown in FIG. 16. Finally, as illustrated in FIG. 17, a fibrous mat reinforced thermosetting resin layer 106 is applied, which covers and encases the refrigerant conduit 34 and forms the inner wall of the frost top unit. The frost top unit is then separated from the mold 88.

Figure 18:
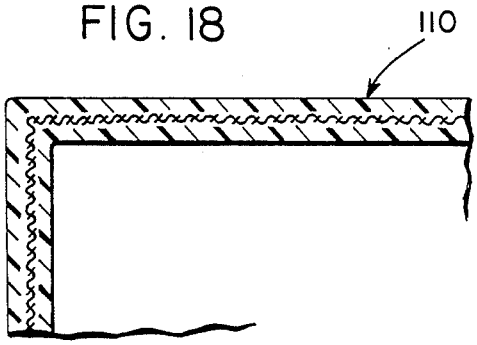
FIG. 18 is a fragmentary cross-sectional view of a portion of a mold for making the base or enclosure for the space below the frost top unit of a refrigerated condiment holder.
Figure 19:
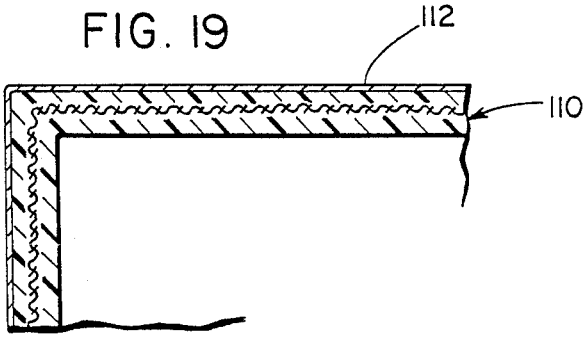
FIGS. 19 to 23 are fragmentary cross-sectional views of a portion of a base or enclosure for the space below the frost top unit of a refrigerated condiment holder showing successive steps of making the base or enclosure in a mold.

FIGS. 18 to 23 illustrate the manufacture of the base 12 or enclosure for the space below the frost top unit 24 of the refrigerated condiment holder. First, a mold 110 of the base 12 is formed in the same general manner as illustrated in FIGS. 6 to 9. The mold 110 is illustrated in FIG. 18. A protective color layer 112, such as a layer of paint, is applied to the mold, as illustrated in FIG. 19. The protective color layer 112 will become the inner surface of the base 12.

Figure 20:
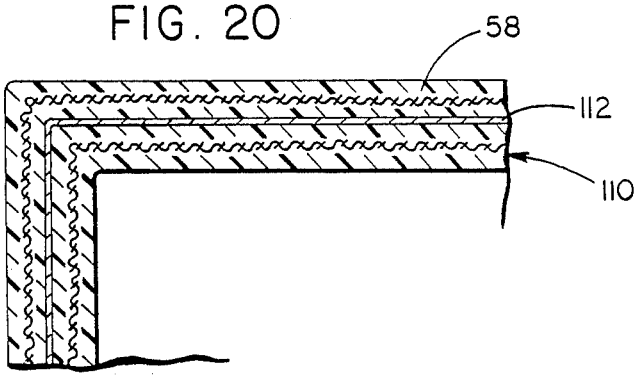
Figure 21:
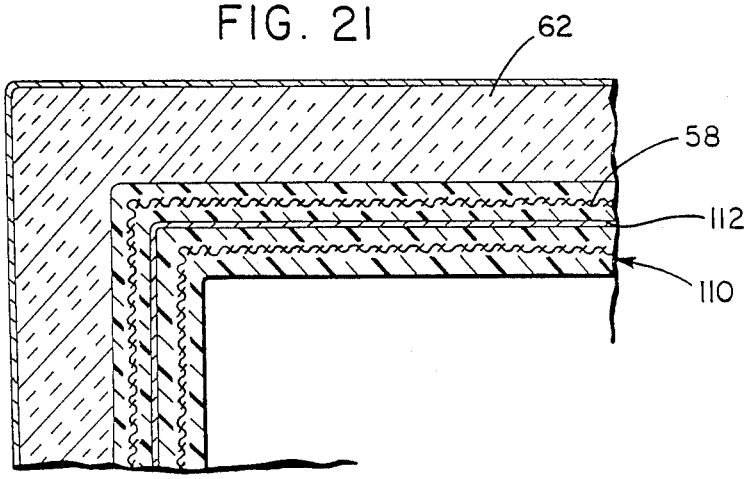

A fibrous mat reinforced thermosetting resin layer which will form bottom wall 58 of base 12 is applied over the protective color layer 112, as illustrated in FIG. 20. A thermal insulation layer 62 is then applied over the fibrous mat reinforced thermosetting resin layer 58. Preferably, the layer of thermal insulation 62 is polyurethane foam insulation having an aluminum foil-backed vapor barrier, as illustrated in FIG. 21.

Figure 22:
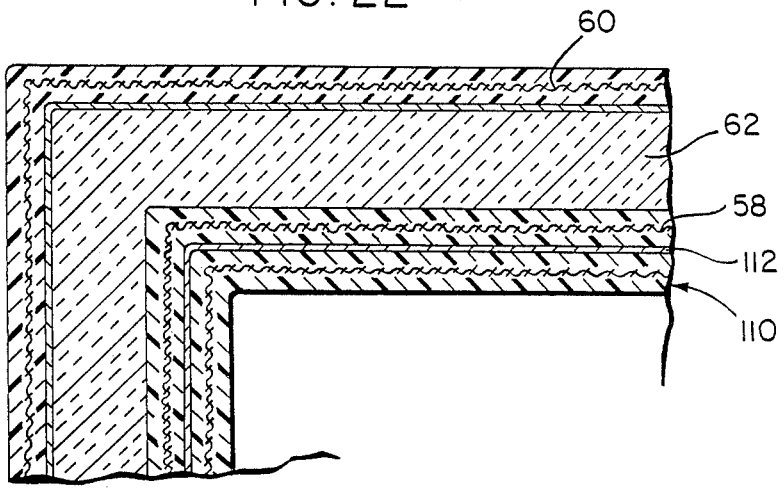
Figure 23:
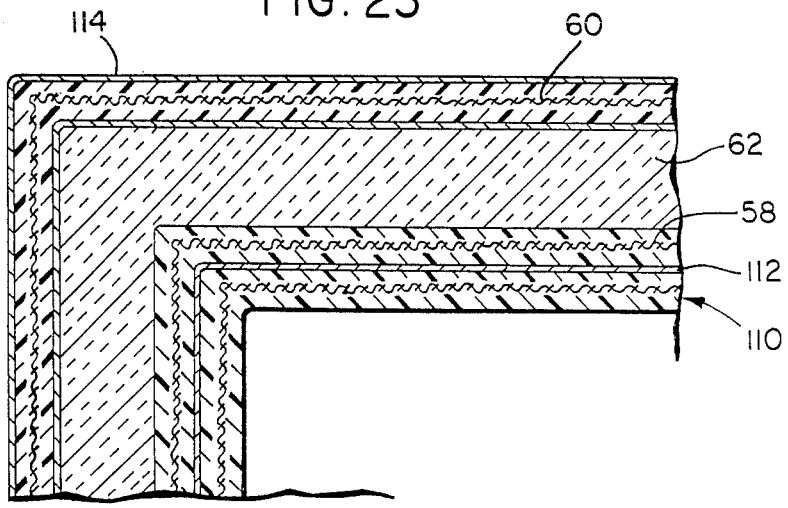

A layer of fibrous mat reinforced thermosetting resin, which will form top wall 60 of base 12 is then applied over the thermal insulation layer 62, as shown in FIG. 22. Finally, a protective color layer 114 is applied, as illustrated in FIG. 23, and becomes the outer surface of the base 12.

Figure 24:
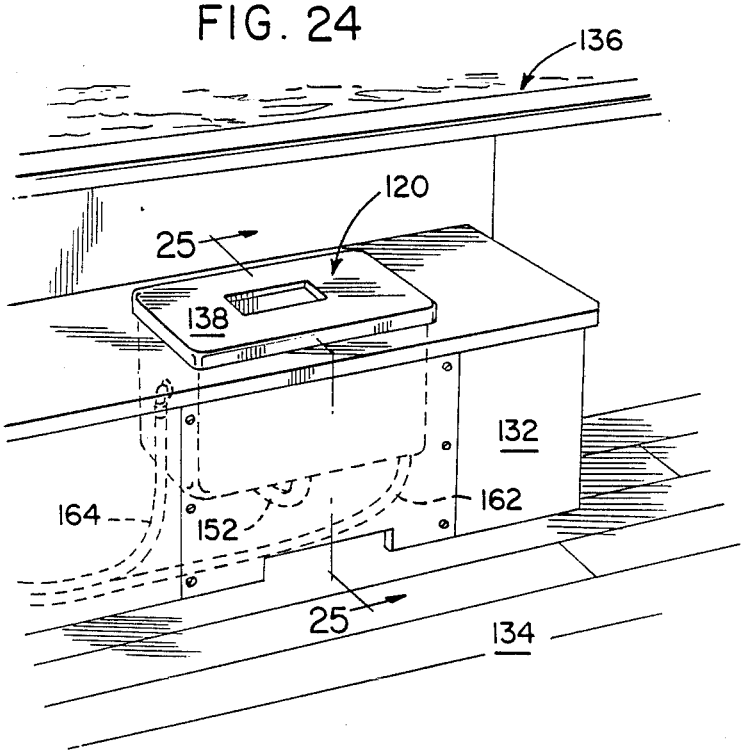
FIG. 24 is a perspective view illustrating a refrigerated chill tank of the present invention.
Figure 27:
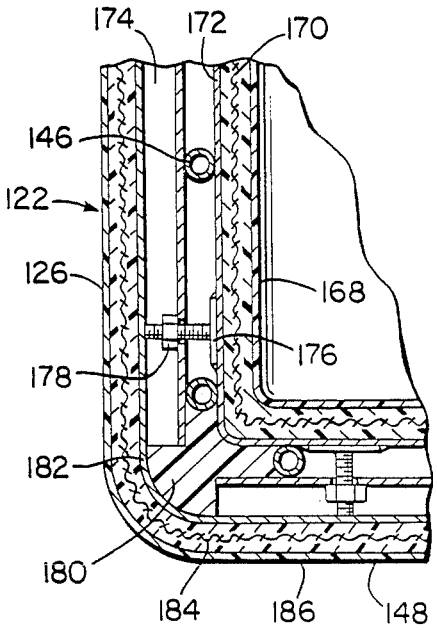
FIG. 27 is a fragmentary cross-sectional view of a corner portion of the chill tank.

Referring to FIGS. 24–28, a refrigerated chill tank generally indicated by reference numeral 120 is shown. Chill tank 120 comprises a generally rectangularly shaped base 122 formed by sidewalls 124 and 126 and end walls 128 and 130. Chill tank 120 is shown in FIG. 24 removably supported by a bulkhead or the like 132 mounted at the rear of the deck 134 of a boat generally indicated by reference numeral 136. Chill tank 120 includes a removable top 138 having an opening 140 for filling the tank with brine or, seawater generally indicated by reference number 142, and/or for placing fish (not shown) in the chill tank. Top 138 has a lip 144 which fits around the upper periphery of base 122.

Figure 25:
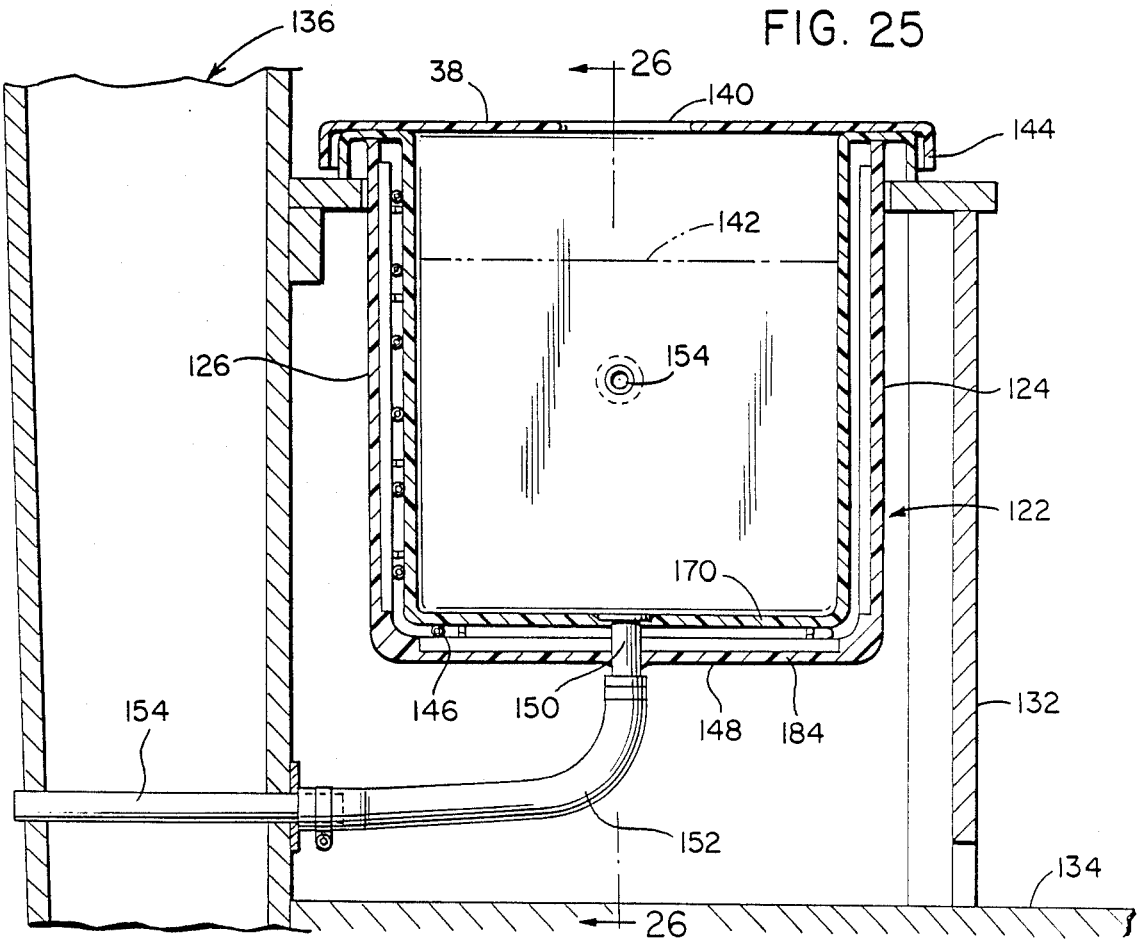
FIG. 25 is a transverse sectional view of the chill tank taken generally along line 25—25 of FIG. 24.
Figure 26:
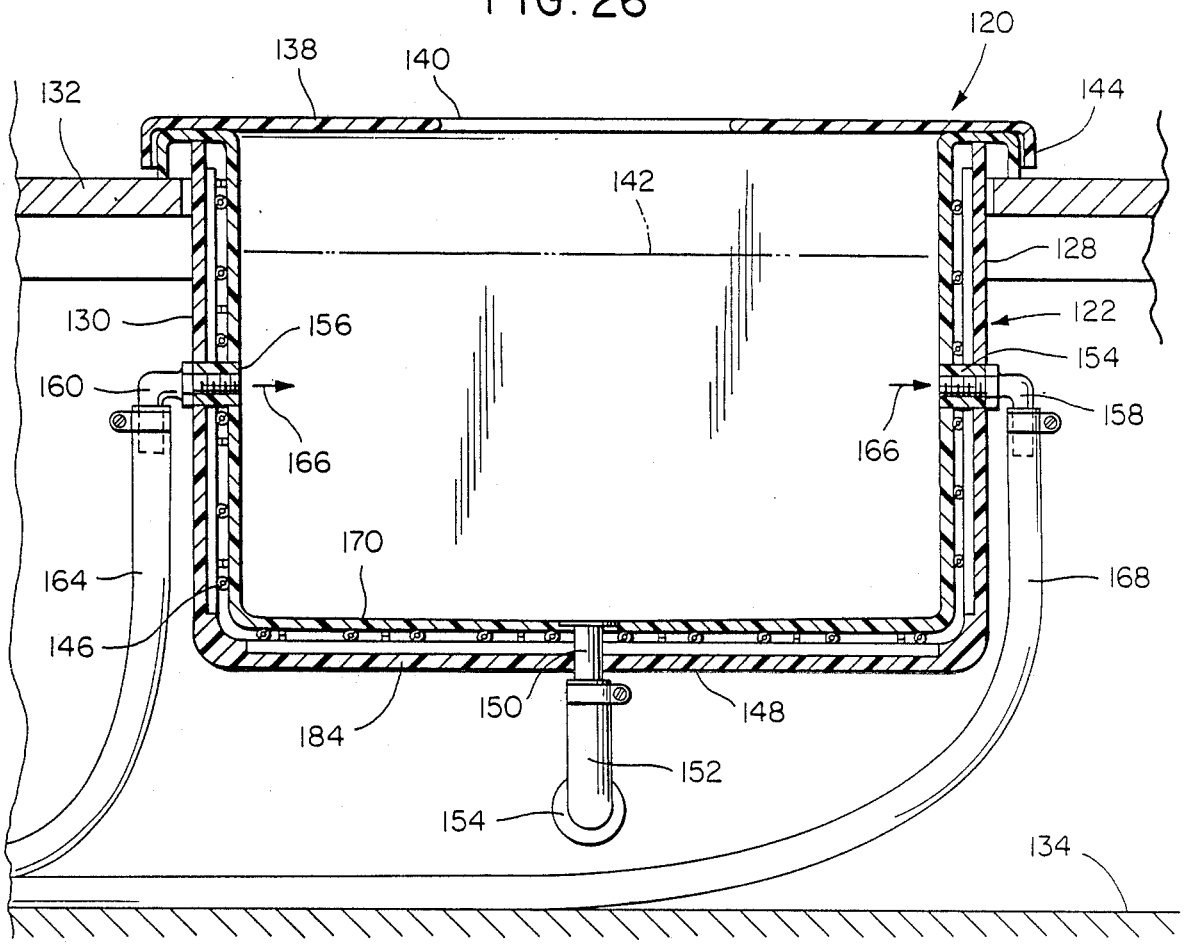
FIG. 26 is a longitudinal sectional view of the chill tank taken generally along the line 26—26 of FIG. 25.
Figure 28:
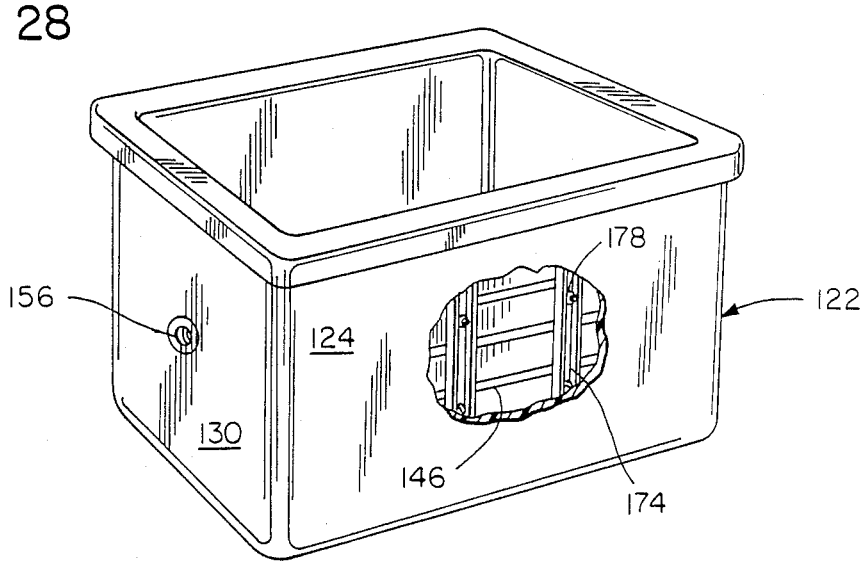
FIG. 28 is a perspective view of the chill tank with a portion of the outside wall removed to better illustrate the construction details.

Positioned in base 122 and embedded therein is refrigerant conduit 146, which can be seen especially in FIGS. 25, 26 and 28 as following a path which travels around the sidewalls and end walls of the base. As can be seen, refrigerant conduit 146 also is embedded in the bottom 148 of the base 122. In this manner, the contents of the chill tank 120, including the brine 142 and any fish contained therein, are refrigerated. As with respect to the frosted condiment holder disclosed herein, refrigerant conduit 146 is essentially the evaporator of a conventional refrigeration system which includes a refrigerant vapor compressor and compressed vapor refrigerant condenser (not shown). Refrigerant conduit 146 is linked to the conventional refrigeration system by means of refrigerant inlet and return lines (not shown).

Chill tank 120 includes a drain 150 which may be connected by any suitable means, such as hose 152 and drain pipe 154, to drain the brine or other liquid contained in chill tank 120. Chill tank 120 also has outlet and inlet openings 154 and 156 which are connected by suitable means, such as outlet and inlet elbow turns 158 and 160, respectively, to outlet and inlet brine recirculation hoses 162 and 164, respectively. Brine recirculation hoses 162 and 164 are connected to a suitable pump for continuously circulating brine in the direction shown by arrows 166 in FIG. 26.

The base 122 of the chill tank 120 is made by molding techniques in substantially the same manner as the frosted condiment holder disclosed herein. As manufactured, the inner surface of the base 122 comprises a protective color layer 168, such as paint. The innermost structural layer of the base 122 is a fibrous mat reinforced thermosetting resin layer 170. As with respect to the frosted condiment holder, the fibrous material is preferably fiberglass, and the thermosetting resin is preferably a polyester resin.

A sheet of heat conducting material 172, such as a sheet of lead, surrounds the fibrous mat reinforced thermosetting resin layer 170. The refrigerant conduit 146 is maintained in good heat conducting contact with the sheet of heat conducting material 170 by a crossbar 174 and by stud 176 and nut 178.

A good heat conducting material 180, such as thermal mastic, surrounds the refrigerant conduit 146. Vapor barrier 182, such as aluminum foil, is adjacent the layer of thermal mastic 180. The outer structural member of the base 122 is a fibrous mat reinforced thermosetting resin layer 184 having an outer protective color layer 186.

The top 138 of chill tank 120 also may be made by molding techniques. Although the top 138 as illustrated has no refrigerant conduit embedded therein, there may be applications in which refrigerant conduit would be included in the top. In these applications, the top would be constructed in substantially the same manner as the base 122.

In operation, a conventional refrigeration system supplies refrigerant to refrigerant conduit 146. Refrigerant is passed through the refrigerant conduit to cool the contents of chill tank 120. Once refrigerant has passed throughout the full circuit laid down by refrigerant conduit 146, warmed refrigerant is returned to the refrigeration unit. Brine is continuously recirculated through base 122 via outlet and inlet refrigerant recirculation lines 162 and 164, respectively. Brine may periodically be removed from the chill tank via drain 150.

The chill tank 120 has significant advantages over prior art chill tanks. In chill tank 120, the refrigerant conduit is completely embedded in and surrounded by fibrous mat reinforced thermosetting resin. Thus, the refrigerant conduit is not exposed to the brine and cannot be damaged by the fish contained in the chill tank. Moreover, the chill tank or other type of refrigerated container used in the boating industry (e.g., freezer unit) may be manufactured inexpensively and efficiently using the molding techniques described in detail with respect to the construction of a frosted condiment holder.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A refrigerated container comprising a top portion containing at least one opening therein, means positioned below said top portion and forming an enclosure for the space below the top portion, a refrigerant path encased in said container and in heat exchange communication therewith so as to cool the enclosed space and the portion of the container therein, and drain means to discharge fluid from said container, said container including fibrous mat reinforced thermosetting resin outer and inner walls, a layer of material for conducting heat, the layer of material being located adjacent one wall, the refrigerant path being located against the layer of material in heat exchange communication therewith, and means for retaining the refrigerant path in heat exchange communication with the layer of material.

2. The refrigerated container of claim 1 wherein the container further includes a layer of thermal mastic adjacent the refrigerator path and a vapor barrier adjacent the layer of thermal mastic.

3. The refrigerated container of claim 1 wherein the fibrous mat reinforced thermosetting resin is fiberglass mat reinforced polyester resin.

4. A condiment holder comprising a top plate containing at least one opening therein, a condiment container inserted into said opening, a refrigerant path encased in said top plate and in heat exchange communication with the outer surface of said top plate so as to cool said top plate and form a layer of frost thereon, means positioned below said top plate and forming an enclosure for the space below the plate whereby the refrigerant path cools the enclosed space and the portion of the container therein, means for collecting condensate from said frost layer formed on said top plate, said collecting means including a fluid discharge means for directing fluid on said collecting means to clean said collecting means form contaminants formed therein, said collecting means including a drain means to remove said condensates and discharged fluid from said condiment holder, said top plate including fibrous mat reinforced thermosetting resin outer and inner walls, a layer of material for conducting heat, the layer of material being located adjacent the outer wall, the refrigerant path being located adjacent the layer of material in heat exchange communication therewith, and means for retaining the refrigerant path in heat exchange communication with the layer of material.

5. The condiment holder of claim 4 wherein the top plate further includes a layer of thermal mastic adjacent the refrigerant path and a vapor barrier adjacent the layer of thermal mastic.

6. The condiment holder of claim 4 wherein the fibrous mat reinforced thermosetting resin is fiberglass mat reinforced polyester resin.

7. The condiment holder of claim 4 wherein the means forming the enclosure comprises fibrous mat reinforced thermosetting resin outer and inner walls surrounding a layer of thermal insulation.

8. The condiment holder of claim 7 wherein the fibrous mat reinforced thermosetting resin is fiberglass mat reinforced polyester resin.

9. A refrigerated condiment holder comprising a frost top unit including a plate having a plurality of openings therethrough for receiving and holding condiment containers with the containers extending substantially into the area below said plate, refrigerant conduit means encased in said plate and in heat exchange relation thereto to form frost on the upper surface of said plate thereby forming a frost top unit, said refrigerant conduit means being disposed outwardly of the periphery of said openings and adjacent the undersurface of the top of the plate to enable containers of different vertical dimensions to be fully inserted into the openings without contact with the refrigerant conduit means, said refrigerant conduit means being disposed adjacent the periphery of said openings to cool the area below the plate and maintain the containers and products therein at a substantially constant cool temperatures throughout the length of the containers, said top plate including fibrous mat reinforced thermosetting resin outer and inner walls, a layer of material for conducting heat, the layer of material being located adjacent the outer wall, the refrigerant path being located adjacent the layer of material in heat exchange communication therewith, and means for retaining the refrigerant path in heat exchange communication with the layer of material.

10. The condiment holder of claim 9 wherein the top plate further includes a layer of thermal mastic adjacent the refrigerant path and a vapor barrier adjacent the layer of thermal mastic.

11. The condiment holder of claim 9 wherein the fibrous mat reinforced thermosetting resin is fiberglass mat reinforced polyester resin.

12. The condiment holder of claim 9 wherein the means forming the enclosure comprises fibrous mat reinforced thermosetting resin outer and inner walls surrounding a layer of thermal insulation.

13. The condiment holder of claim 12 wherein the fibrous mat reinforced thermosetting resin is fiberglass mat reinforced polyester resin.

14. The refrigerated condiment holder of claim 9 wherein the area below the plate is enclosed by a depending peripheral wall and a bottom wall, said refrigerant conduit means cooling said area and the entire surface area of the containers extending below said plate.

15. The refrigerated condiment holder of claim 14 wherein said peripheral wall and bottom wall include a layer of thermal insulation to maintain a substantially constant temperature in the enclosed area below the plate.

16. The refrigerated condiment holder of claim 14 wherein said bottom wall includes a drain opening, said bottom wall being inclined toward said drain opening for gravity flow to the drain opening, a plurality of spray nozzle means located remotely from the drain opening and adjacent peripheral areas of the bottom wall and discharging liquid cleaning solution at points adjacent the bottom wall and in the direction of the drain openings for flush cleaning of the interior surfaces of the walls.

17. The refrigerated condiment holder of claim 14 wherein said containers are constructed of heat conducting material with the containers having a top lip engaging the periphery of the openings with the refrigerant conduit means also forming frost on the lip at the upper end of the containers above the plate to provide the appearance of mounds of ice around the containers.

18. A method of making a refrigerated container comprising forming a plug of at least a portion of the refrigerated container, using the plug to form a mold of the at least a portion of the refrigerated container, the mold being formed by applying a layer of fibrous mat reinforced thermosetting resin to the plug, applying a protective color layer to the fibrous mat reinforced thermosetting resin layer, applying a release layer to the protective color layer, and separating the mold from the plug, using the mold to form at least a portion of the refrigerated container by applying a protective color layer to the mold, applying a layer of fibrous mat reinforced thermosetting resin over the protective color layer, applying a sheet of heat conducting material over the fibrous mat reinforced thermosetting resin layer, applying refrigerant conduit means at spaced locations over the sheet of heat conducting material, providing means to maintain the refrigerant conduit means in good heat conducting contact with the sheet of heat conducting material, covering and encasing the refrigerant conduit means with a layer of fibrous mat reinforced thermosetting resin, and separating the at least a portion of the refrigerated container from the mold.

19. The method of claim 18 wherein a layer of thermal mastic is applied adjacent the refrigerant conduit means and a vapor barrier is applied adjacent the layer of thermal mastic such that the thermal mastic and vapor barrier are covered by and encased in fibrous mat reinforced thermosetting resin.

20. The method of claim 18 wherein the fibrous mat reinforced thermosetting resin is fiberglass mat reinforced polyester resin.

21. The method of claim 18 wherein the refrigerated container is a condiment holder and the method is used to form a top plate containing at least one opening therein.

22. The method of claim 18 in which the condiment holder includes means positioned below the top plate and forming an enclosure for the space below the plate to be cooled by the refrigerant conduit means, the means forming the enclosure being made by applying a layer of fibrous mat reinforced thermosetting resin to a mold, applying a layer of thermal insulation over the fibrous mat reinforced thermosetting resin, applying a layer of fibrous mat reinforced thermosetting resin over the thermal insulation layer, and separating the means forming the enclosure from the mold.

23. The method of claim 22 wherein the fibrous mat reinforced thermosetting resin is fiberglass mat reinforced polyester resin.

* * * * *